US009296098B2

(12) United States Patent
Wang

(10) Patent No.: US 9,296,098 B2
(45) Date of Patent: Mar. 29, 2016

(54) NAILING DEVICE WHOSE STRIKER IS PRE-SEPARATED FROM NAIL

(75) Inventor: Jing-Li Wang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 928 days.

(21) Appl. No.: 13/477,457

(22) Filed: May 22, 2012

(65) Prior Publication Data

US 2013/0228605 A1 Sep. 5, 2013

(30) Foreign Application Priority Data

Mar. 2, 2012 (TW) ..... 101106886 A

(51) Int. Cl.
*B25C 5/11* (2006.01)

(52) U.S. Cl.
CPC ..... *B25C 5/11* (2013.01)

(58) Field of Classification Search
CPC ..... B25C 5/06; B25C 5/10; B25C 5/11; B25C 5/025; B25C 5/0235; B25C 5/0242; B25C 5/0292
USPC ..... 227/8, 120, 130, 132
See application file for complete search history.

(56) References Cited

U.S. PATENT DOCUMENTS

| | | | | |
|---|---|---|---|---|
| 5,505,362 | A | 4/1996 | Marks | |
| 5,699,949 | A * | 12/1997 | Marks | 227/132 |
| 5,816,470 | A | 10/1998 | Plato et al. | |
| 6,789,719 | B2 * | 9/2004 | Shor | 227/132 |
| 7,097,086 | B2 * | 8/2006 | Joyce et al. | 227/120 |
| 7,243,832 | B2 * | 7/2007 | Jiang | 227/120 |
| 7,540,400 | B2 * | 6/2009 | Zins et al. | 227/8 |
| 7,681,771 | B2 * | 3/2010 | Kandasamy et al. | 227/134 |

* cited by examiner

*Primary Examiner* — Gloria R Weeks
*Assistant Examiner* — Justin Citrin
(74) *Attorney, Agent, or Firm* — Muncy, Geissler, Olds & Lowe PC

(57) ABSTRACT

A nailing device of the present invention mainly includes a striker for driving nails, a restriction mechanism, a power storing mechanism, and an operation mechanism. By cooperation of the components, the striker is kept in position without moving during the course of power storing, and the striker is automatically recovered to an initial position after firing. Thus, nail can fill to the right position accurately in continuous work. For continuously and quickly working, the nailing device is protected from nail jamming.

7 Claims, 6 Drawing Sheets

NAILING DEVICE WHOSE STRIKER IS PRE-SEPARATED FROM NAIL

BACKGROUND OF THE INVENTION

1. Field of the Invention

The present invention relates to a nailing device.

2. Description of the Prior Art

Conventional nailing device, as described in U.S. Pat. No. 5,505,362, U.S. Pat. No. 5,816,470, or U.S. Pat. No. 6,789,719, has a handle for user to press. By connection of linkage, the handle drives striker to move, lifts the striker, and compresses spring or elastic plate. The spring or the elastic plate saves power for strike. As the striker is further lifted, the striker separates from the linkage. The striker is then moved by the power saved by the spring or elastic plate, and moves downwardly quickly for firing nail.

Such nailing device can be malfunctioned easily in practical using. In the nailing device, the firing mechanism is achieved by automatic separation of the linkage which moves in a sector and the striker which moves is a line. After long or heavy use, the striker and the linkage would be abraded. Timing of separation of the linkage and the striker is then advanced. As a result, the power saved by spring is decreased. Nail may be fired with a weakened power which is not enough for nailing objects. Secondly, size and position inaccuracy caused in manufacturing or caused by collision can considerably change the timing of the separation, also. As a result, the nailing device would work with weakened power or even malfunction frequently.

In addition, some other reasons may cause malfunction of the nailing device, also. In the nailing device, the striker is generally kept located at the position where the striker strikes the nail. In other words, the striker stays behind after striking the nail. The striker would keep touching and block the rest nails until the linkage lift the striker again. After then, the nails moves forward and the striker moves downward after releasement, and the firing mechanism is completed. If user drives the handle and the striker continuously and quickly, the nail may not be able to move forward to the accurate firing position immediately. As a result, the nail would be intruded into the firing hole, damaging the nailing device.

The present invention is, therefore, arisen to obviate or at least mitigate the above mentioned disadvantages.

SUMMARY OF THE INVENTION

The main object of the present invention is to provide a durable nailing device which is suitable for continuous working.

To achieve the above and other objects, a nailing device whose striker is pre-separated from nail of the present invention includes a housing, a striker, a restriction mechanism, a power storing mechanism, and an operation mechanism.

The striker is slidably disposed in the housing. The striker is able to slide linearly along a striking direction between an initial position and a strike position. The striker drives a nail out of the housing when the striker slides from the initial position to the strike position.

The restriction mechanism is utilized for restricting the striker when the striker is located at the initial position, so that the striker is kept located at the initial position. The restriction mechanism is able to be triggered off to release the striker. Releasement of the restriction mechanism makes the striker to be able to slide arbitrarily.

The power storing mechanism abuts against the striker. The power storing mechanism is able to switch between a repose condition and a store condition. The power storing mechanism exerts an elastic force on the striker under the store condition. The elastic force gives the striker a tendency to slide toward the strike position.

The operation mechanism is utilized for switching the power storing mechanism between the repose condition and the store condition.

The striker is kept located at the initial position during course of switching the power storing mechanism from the repose condition to the store condition.

Accordingly, in operation, the striker would be kept in position when user presses on the operation mechanism. Nail can move to the accurate position before user drives the nailing device. Though the nailing device works continuously and quickly, the nails can still move to the accurate position quickly. Thus, opportunity of malfunction or damage of the nailing device is reduced.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
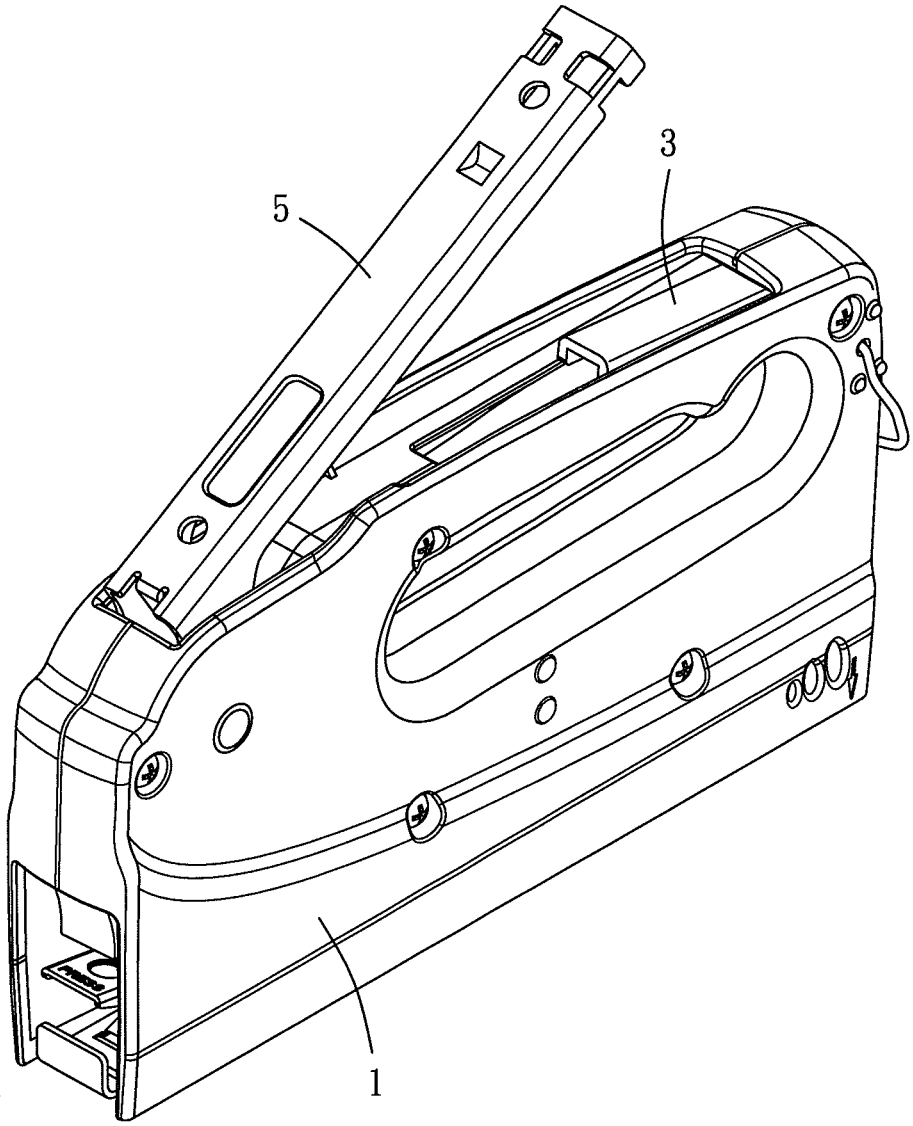
FIG. 1 is a stereogram showing a first embodiment of the present invention.
Figure 2:
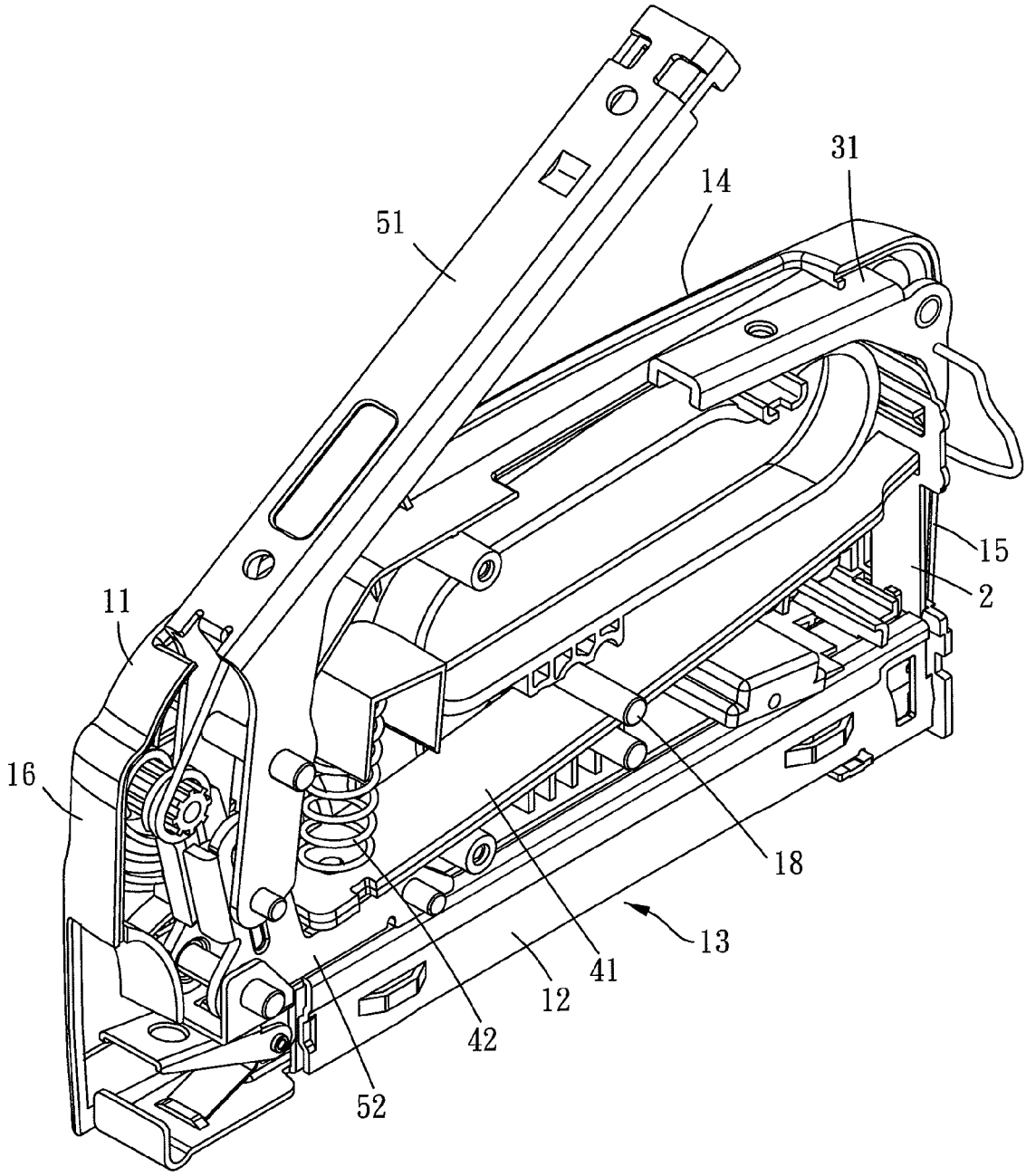
FIG. 2 is a stereogram showing internal structure of a first embodiment of the present invention.
Figure 3:
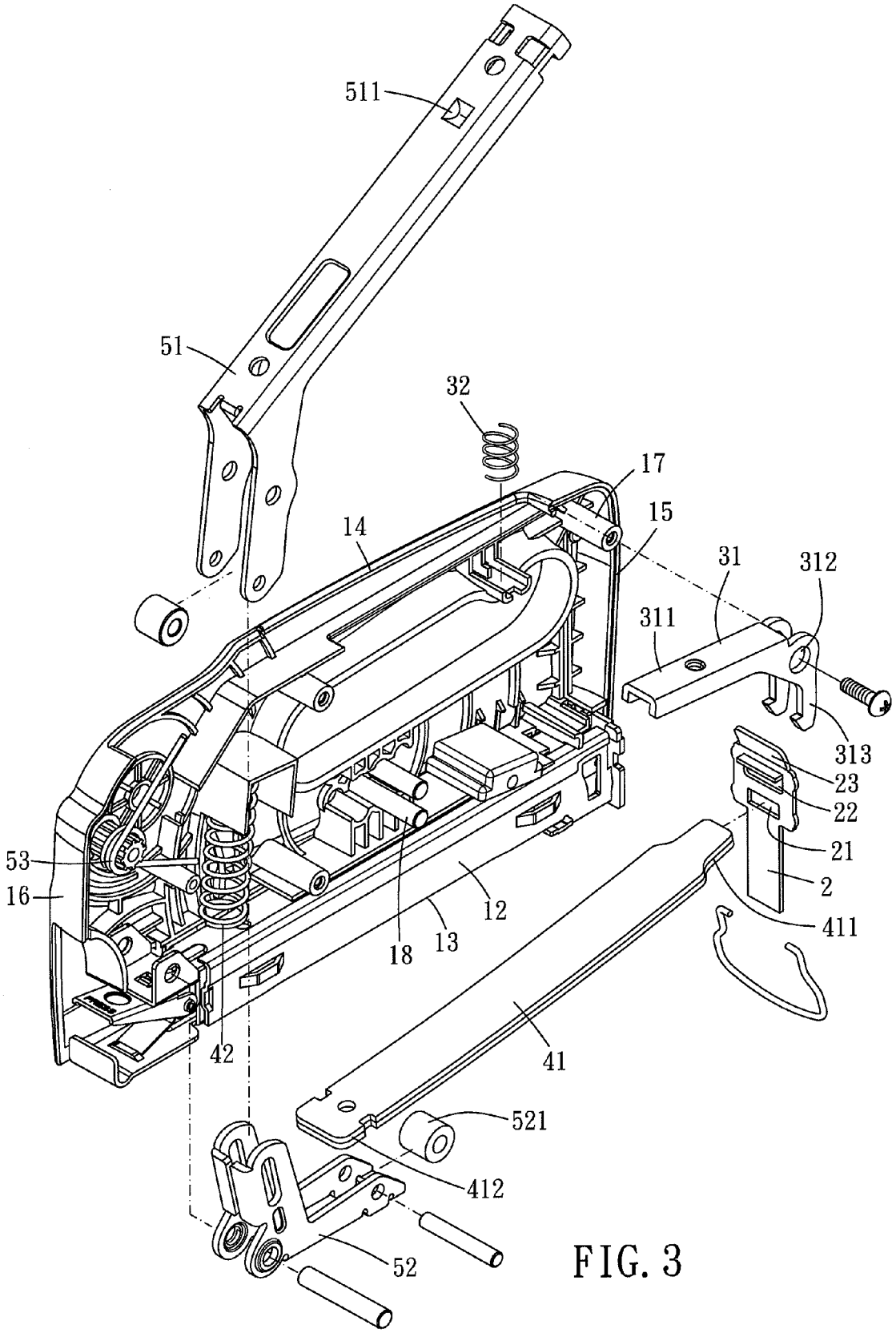
FIG. 3 is a breakdown drawing showing a first embodiment of the present invention.

Please refer to FIG. 1 for a first embodiment of the present invention. The nailing device of the present embodiment is provided for receiving nails and adapted for user to manually press down for storing power for striking the nail on an object. Please refer to FIG. 1 to FIG. 3, the nailing device of the present embodiment includes a housing 1, a striker 2, a restriction mechanism 3, a power storing mechanism, and an operation mechanism 5.

The housing mainly includes two semi-housings 11 and a magazine 12. The semi-housings 11 are affixed to each other by screws, adapted for the magazine 12 and other components to be received and disposed in the housing 1. The housing has a bottom side 13, a top side 14 corresponding to the bottom side, and a front side 15 and a rear side 16 which are corresponding to each other. The bottom side 13 is adapted for abutting against an object and for nails to be strike out from. The magazine 12 is loaded and received in the housing from the rear side 16, so that the nails filled inside can be stroke out from the bottom side 13 approaching the front side 15.

The striker 2 is slidably disposed in the housing 1, more specifically, is vertically located approaching to the front end 15 and above the magazine 12. The striker 2 is able to linearly slide along a striking direction between an initial position and a strike position. The striker 2 moves downwardly toward the bottom side 13 and drives the nail beneath out of the housing 1 when the striker 2 moves from the initial position toward the strike position. The striker 2 is provided as a plate. The striker 2 is formed with a mount slot 21 and an engage slot 22. A top end of the striker 2 is formed with a guide plate 23 which is bent and tilted aiming the top side 14 and the rear side 16.

Figure 4:
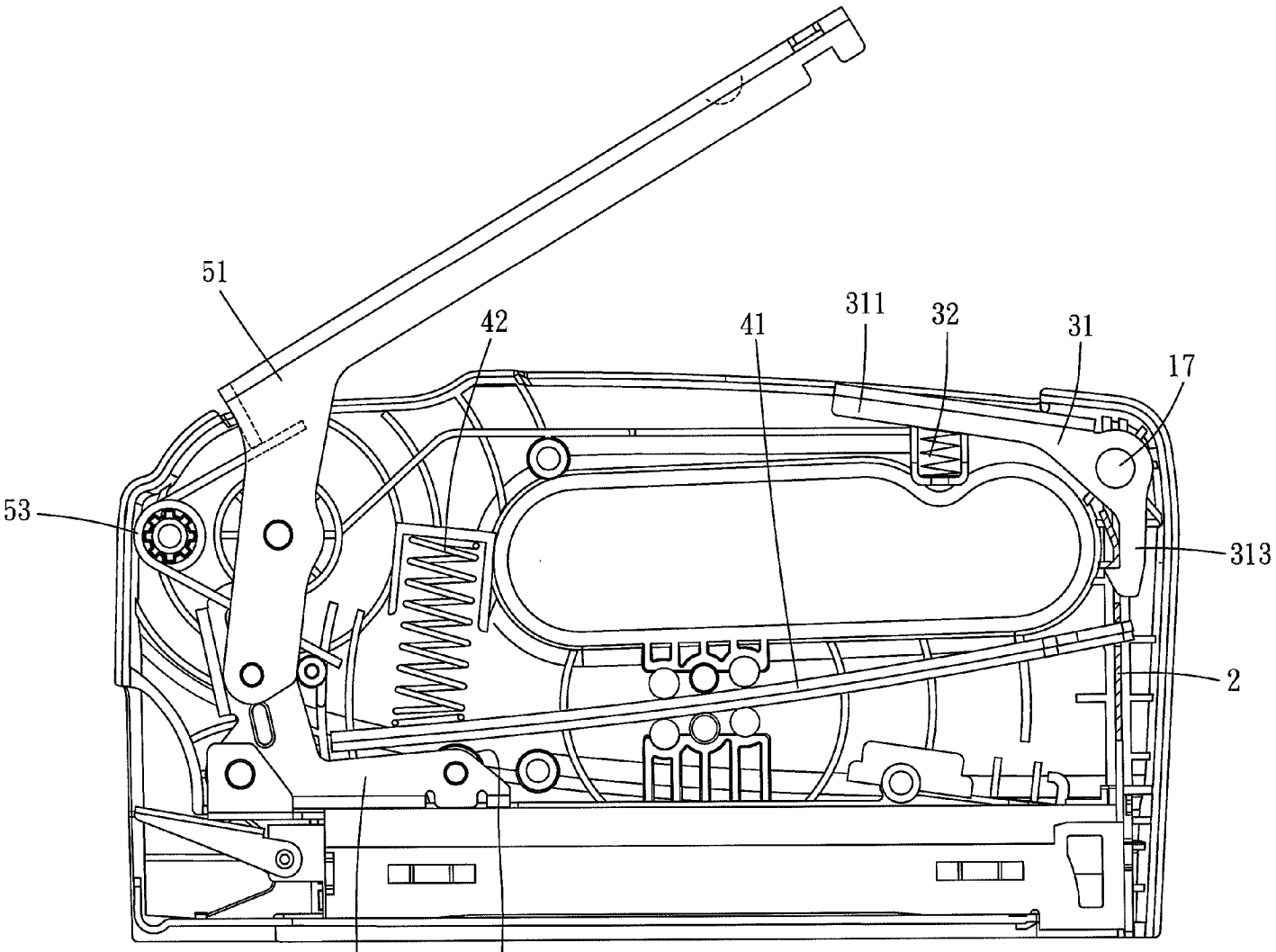
FIG. 4 is a profile showing a first embodiment of the present invention.

The restriction mechanism 3 is utilized for restricting the striker 2 when the striker 2 is located at the initial position, so that the striker 2 is kept located at the initial position. The restriction mechanism 3 can be triggered off to release the striker 2. Releasement of the restriction mechanism 3 makes the striker 2 to be able to slide arbitrarily. More specifically, the restriction mechanism 3 includes a pivotable member 31 and a recovery spring 32. The pivotable member 31 has a trigger section 311, a pivoting hole 312, and an engage section 313. The pivoting hole 312 is located between the trigger section 311 and the engage section 313. The pivoting hole 312 sleeves about a pole 17 which is formed in the housing. Thus, the pivotable member 31 is pivotably mounted to the housing 1 about an axis which is defined by the pivoting hole 312 and the pole 17. The pole 17 is located between the trigger section 311 and the engage section 313. More particularly, the trigger section 311 extends from the pole 17 toward the rear side 16, and partially exposes outwardly from the top side 14. Thus, the trigger section 311 is adapted for user or other components to press thereon. The engage section 313 extends from the pole 17 toward the bottom side 13. The distal end of the engage section 313 is formed with a hook. The pole 17 is located above the striker 2. In other words, a direction of the pole 17 relative to the striker 2 or a direction aiming form the striker 2 toward the pole 17 is opposite to the striking direction. Thus, the distal end of the trigger section 311 and the distal end of the engage section 313 are respectively located at sides divided by an extension from the striking direction. The pivotable member 31 is able to pivot between an engage position and a release position. When the pivotable member 31 is located at the engage position and the striker 2 is located at the initial position, as shown in FIG. 4, the engage section 313 moves toward the rear side 16 and engages the engage slot 22. Thus, the striker 2 is kept located at the initial position and is unable to slide toward the strike position. When the pivotable member 31 is located at the release position, the engage section 313 is released from the engage slot 22. Thus, the striker 2 is able to slide arbitrarily. When the pivotable member 31 pivots between the engage position and the release position, the movement direction of the distal end of the trigger section 311 is substantially parallel to the striking direction, and the movement direction of the distal end of the engage section 313 is substantially perpendicular to the striking direction. In fact, by pivot of the pivotable member 31, the distal ends of the trigger section 311 and the engage section 313 move along arc paths, rather than straight lines. That is to say, movement directions of the distal ends of the trigger section 311 and the engage section 313 can not be kept exactly parallel or perpendicular to the striking direction. However, the movement directions here still approach the directions as described above.

The recovery spring 32 of the restriction mechanism abuts against the pivotable member 31 and the housing 1. More particularly, the recovery spring 32 abuts against the trigger section 311, inducing an elastic recovery force to press on the pivotable member 31. Thus, the pivotable member 31 is generally located at the engage position.

The power storing mechanism abuts against the striker 2. The poser storing mechanism can be switched between a repose condition and a store condition. Under the store condition, the power storing mechanism exerts an elastic force on the striker 2. The elastic force gives the striker 2 a tendency to slide toward the strike position. Thus, once the restriction mechanism 3 is triggered off and the pivotable member 31 sways to the release position, the striker 2 would move downwardly quickly and drive a nail out of the housing. More specifically, the power storing mechanism includes an elastic plate 41 and a recovery spring 42. The elastic plate 41 has a first end 411 and a second end 412 which are away from each other. The elastic plate 41 is sandwiched by two pins 18 which are adjustably disposed in the housing 1 so as to arrange the elastic plate 41 in the housing 1. The elastic plate 41 is able to pivot with respect to the housing 1, so that the first end 411 and the second end 412 moves along opposite directions when the elastic plate 41 sways. The first end 411 inserts into the mount slot 21 of the striker, making the striker 2 move together with the first end 411. The second end 412 extends toward the rear side 16. The elastic plate 41 is adapted for bending, switching the power storing mechanism to the store condition. Said bending is to bend and deform the elastic plate 41 temporarily. The original appearance of the elastic plate 41 may be, but not limited in flat plate or curved plate. The recovery spring 42 abuts against the second end 412 and the housing 1. The recovery spring 42 induces a recovery force to press on the elastic plate 41. Because of the recovery force, the second end 412 of the elastic plate 41 generally moves toward the bottom side 13, and the first end 411 generally moves toward the top side 14. Thus, the striker 2 is generally recovered to the initial position.

The operation mechanism 5 is used for switching the power storing mechanism between the repose condition and the store condition. More specifically, the operation mechanism 5 includes a handle 51 and a linkage 52. The handle 51 is pivotably mounted to the housing 1, approaching to the rear side 16 and the top side 14. The handle 51 can switch, actually pivot in the embodiment, between a general position and an operation position. One end of the handle 51 extends toward the front side 15 and is exposed outwardly to the surrounding. Preferably, the handle 51 can be further covered by plastic cover. Thus, the handle is suitable for user to press and sway. The other end of the handle 51 extends toward the bottom side 13. The linkage 52 is pivotably mounted to the housing 1. One end of the linkage 52 extends toward the top side 14 and pivotably mounted to the end of the handle 51 which extends toward the bottom side 13. The other end of the linkage 52 extends toward the front side 15 and abuts against a lower surface of the second end 412 of the elastic plate. Preferably, the linkage 52 is provided with roller 521 which serves for abutting the elastic plate 41. The operation mechanism may further include a torsion spring 53. The torsion spring 53 abuts against the handle 51 and the housing 1, so that the handle 51 is generally located at the general position.

Accordingly, please refer to FIG. 4, by the contribution of the elastic forces provided by the recovery springs 32, 42, the torsion spring 53, and the elastic plate 41, the handle 51 is generally located at the general position. The elastic plate 41 is under the repose condition. The striker 2 is located at the initial position. The pivotable member 31 of the restriction mechanism is located at the engage position. Thus, the engage section 313 engages the striker 2, and the striker 2 is kept located at the initial position.

Figure 5:
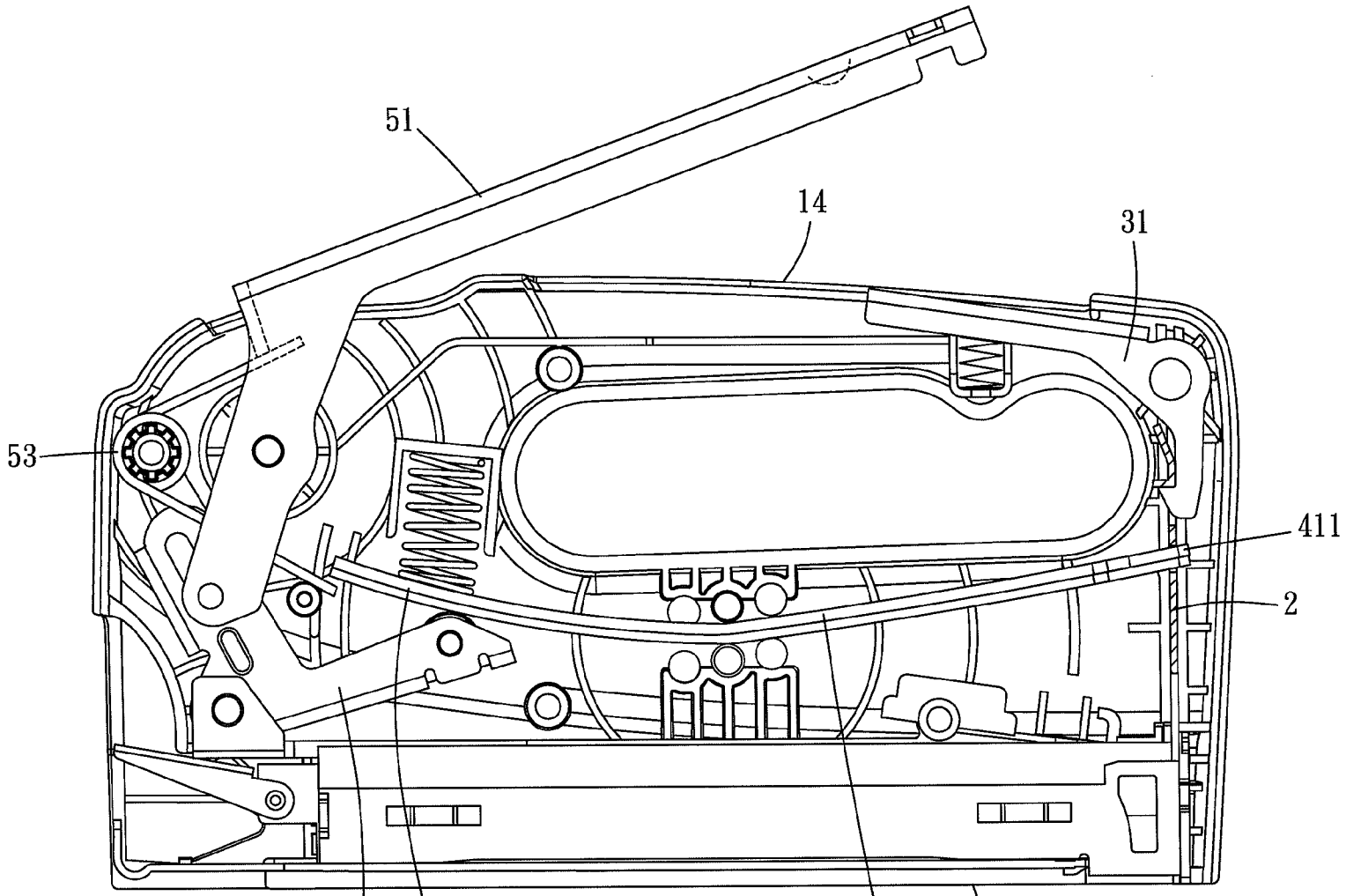
FIG. 5 and FIG. 6 are schematic drawings showing an operation condition of a first embodiment of the present invention.

Please refer to FIG. 5. When user tries to operate the nailing device, the handle 51 is manually pressed to sway toward the operation position. Then, the linkage 52 pushes the second end 412 of the elastic plate 41 toward a direction which aims the top side 14 and opposites to the striking direction. Since the first end 411 of the elastic plate 41 inserts in the striker 2, and motion of the striker 2 is restricted at the initial position by the restriction mechanism, both of the first end 411 and the striker 2 are unable to move. Thus, the elastic plate 41 is pressed and bent. The power storing mechanism is then switched to the store condition.

Figure 6:
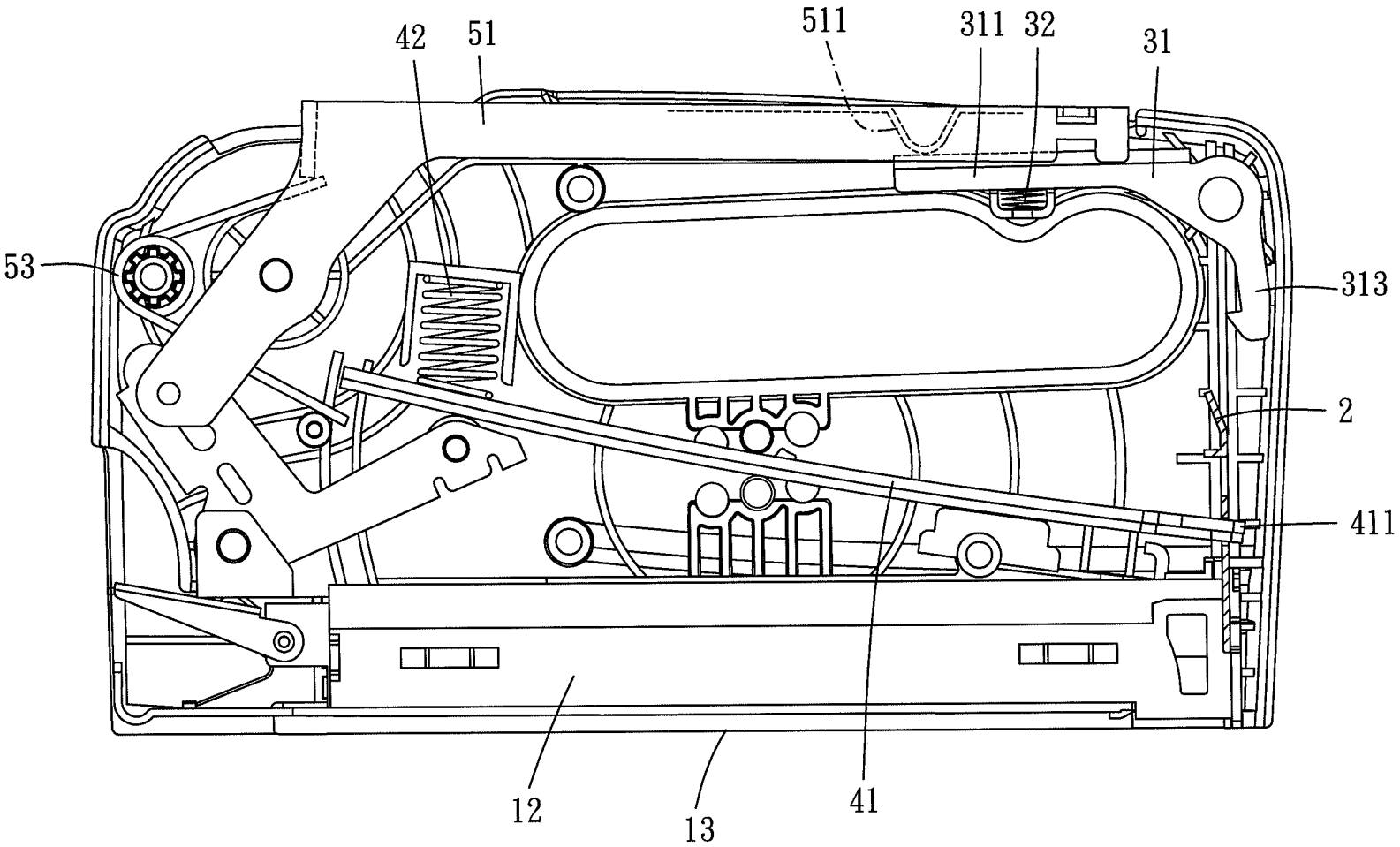

Please refer to FIG. 6. User can further press the handle 51. As the handle 51 sways, the handle 51 would finally touch and trigger off the trigger section 311 of the pivotable member 31. The trigger section 311 is pressed downward toward the bottom side 13, so that the pivotable member 31 sways to the release position. The engage section 313 disengages with the engage slot of the striker 2. Accompanied with the disengagement, the striker 2 is moved quickly and downwardly along the striking direction toward the bottom side 13 because of the elastic force provided by the elastic plate 41. Thus, the nail located under the striker 2 is driven or stroke out of the housing. To ensure the trigger section 311 being triggered off, the handle 51 may be formed with a protrusion 511 corresponding to the trigger section 311. The protrusion 511 can press the trigger section 311 in operation.

When the handle 51 is released, the components are recovered to the positions as shown in FIG. 4 by the elastic forces provided by the recovery springs 32, 42, the torsion spring 53, and the elastic plate 41. Thus, the nailing device is suitable for continuous operation.

According to the embodiment, the nailing device has a striker which is pre-separated from the nail loaded in the nailing device. After nail is driven out of the housing, the next nail can move forward and fill the vacancy immediately before user press the handle again. Thus, chance of nail filling inaccuracy is considerably reduced. Motion of the nail and the striker is smoothened. Nailing device is protected from nail jamming. In addition, the nail device is suitable for working continuously and quickly.

Moreover, the striker is general separated from nails. Abrasion of the striker caused by nail contact is minimized. Rust of the nails can now seldom damage the striker. Thus, lifetime of the striker of the nailing device is prolonged.

Besides, the linkage equipped in the nailing device pushes the second end of the elastic plate which is located away from the striker. Thus, lever of the linkage can be controlled for labor-saving.

What is claimed is:

1. A nailing device whose striker is pre-separated from nail, comprising:

a housing;

a striker, slidably disposed in the housing, the striker being able to slide linearly along a striking direction between an initial position and a strike position, the striker driving a nail out of the housing when the striker slides from the initial position to the strike position;

a restriction mechanism, utilized for restricting the striker when the striker is located at the initial position, so that the striker is kept located at the initial position, the restriction mechanism being able to be triggered off to release the striker, releasement of the restriction mechanism making the striker to be able to slide along the striking direction;

a power storing mechanism, abutting against the striker, the power storing mechanism being able to switch between a repose condition and a store condition, the power storing mechanism exerting an elastic force on the striker under the store condition, the elastic force giving the striker a tendency to slide toward the strike position;

an operation mechanism, utilized for switching the power storing mechanism between the repose condition and the store condition;

wherein the striker is kept located at the initial position during course of switching the power storing mechanism from the repose condition to the store condition;

wherein the power storing mechanism comprises an elastic plate, the elastic plate is pivotably disposed in the housing, the elastic plate has a first end and an opposite second end, the elastic plate has a support portion located between the first end and the second end, the support portion is positioned in the housing by a support mechanism so that the support portion is immovable along the striking direction, the first end of the elastic plate abuts against the striker, the elastic plate is bent to be switched to the store condition when the second end of the elastic plate is pressed against by the operation mechanism;

wherein the striker is formed with a mount slot, the first end inserts into the mount slot, the operation mechanism presses the elastic plate along a direction which is substantially parallel to the striking direction, the first end and second end move along directions which are substantially opposite to each other when the elastic plate pivots, the operation mechanism comprises a handle, the handle is able to switch between a general position and an operation position, the operation mechanism presses against the second end and bends the elastic plate so as to switch the power storing mechanism to the store condition when motion of the handle from the general position toward the operation position is activated.

2. The nailing device of claim 1, wherein the handle is pivotably mounted to the housing, so that the handle is able to pivot between the general position and the operation position, the operation mechanism further comprises a linkage, the linkage is pivotably mounted to the housing, one end of the linkage is pivotably mounted to one end of the handle, a distal end of the handle is adapted for pressing, a distal end of the linkage abuts against the second end of the elastic plate.

3. The nailing device of claim 2, wherein the power storing mechanism further comprises a recovery spring, the recovery spring induces a recovery force to press on the elastic plate, so that the striker tends to move back to the initial position.

4. The nailing device of claim 1, wherein the power storing mechanism further comprises a recovery spring, the recovery spring induces a recovery force to press on the elastic plate, so that the striker tends to move back to the initial position.

5. The nailing device of claim 1, wherein the power storing mechanism further comprises a recovery spring, the recovery spring induces a recovery force to press on the elastic plate, so that the striker tends to move back to the initial position.

6. The nailing device of claim 5, wherein the recovery spring abuts against the second end of the elastic plate.

7. The nailing device of claim 3, wherein the recovery spring abuts against the second end of the elastic plate.

* * * * *